US008331828B2

(12) United States Patent
Tanisawa

(10) Patent No.: US 8,331,828 B2
(45) **Date of Patent: *Dec. 11, 2012**

(54) IMAGE FORMING APPARATUS INCLUDING A DEVELOPING DEVICE WITH TONER SUPPLY PASSAGE HAVING A MAGNETIC FIELD FORMED INSIDE AND TONER SUPPLY CONTROL METHOD USING THE SAME

(75) Inventor: Hiroshi Tanisawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 653 days.

This patent is subject to a terminal disclaimer.

(21) Appl. No.: 12/539,672

(22) Filed: Aug. 12, 2009

(65) Prior Publication Data

US 2010/0061769 A1 Mar. 11, 2010

(30) Foreign Application Priority Data

Sep. 9, 2008 (JP) ..... 2008-231119

(51) Int. Cl.
*G03G 15/08* (2006.01)

(52) U.S. Cl. ..... 399/254; 399/255; 399/258; 399/260; 399/262

(58) Field of Classification Search ..... 399/254, 399/255, 260
See application file for complete search history.

(56) References Cited

U.S. PATENT DOCUMENTS

| | | | | |
|---|---|---|---|---|
| 5,095,338 | A * | 3/1992 | Hayes et al. | 399/257 |
| 5,685,348 | A * | 11/1997 | Wegman et al. | 141/2 |
| 5,727,607 | A * | 3/1998 | Ichikawa et al. | 141/67 |
| 6,067,431 | A * | 5/2000 | Bakker | 399/252 |
| 7,167,668 | B2 | 1/2007 | Sekiguchi | |
| 8,126,371 | B2 * | 2/2012 | Akedo | 399/254 |
| 2005/0175376 | A1 * | 8/2005 | Sekiguchi | 399/258 |
| 2010/0104305 | A1 * | 4/2010 | Morimoto | 399/58 |

FOREIGN PATENT DOCUMENTS

| | | |
|---|---|---|
| JP | 04-063378 | 2/1992 |
| JP | 2001-083802 | 3/2001 |
| JP | 2003-084555 | 3/2003 |
| JP | 2006/171037 | 6/2006 |

* cited by examiner

*Primary Examiner* — David Gray
*Assistant Examiner* — Geoffrey Evans
(74) *Attorney, Agent, or Firm* — Renner, Otto, Boisselle & Sklar, LLP

(57) ABSTRACT

A developing device includes: a first conveying passage (developer conveying passage) through which a developer containing a toner and a magnetic carrier is conveyed; a first conveying member (developer conveying member) provided in the first conveying passage for agitating and conveying the developer in a predetermined direction; and a toner supply pipe for leading supplementary toner to the first conveying passage. The developing device further includes electromagnets for forming a magnetic field inside the toner supply pipe to create a magnetic brush shutter by means of the electromagnets.

3 Claims, 6 Drawing Sheets

IMAGE FORMING APPARATUS INCLUDING A DEVELOPING DEVICE WITH TONER SUPPLY PASSAGE HAVING A MAGNETIC FIELD FORMED INSIDE AND TONER SUPPLY CONTROL METHOD USING THE SAME

This Nonprovisional application claims priority under 35 U.S.C. §119(a) on Patent Application No. 2008-231119 filed in Japan on 9 Sep. 2008, the entire contents of which are hereby incorporated by reference.

BACKGROUND OF THE INVENTION (1) Field of the Invention

The present invention relates to a developing device capable of being supplied with toner and an image forming apparatus and a toner supply control method using the same device, in particular relating to a developing device using a developer containing a toner and a magnetic carrier, which can make exact control of the amount of toner supply and an image forming apparatus and a toner supply control method using the same device.

(2) Description of the Prior Art

The image forming apparatus using the electrophotography is, in general, an apparatus that forms images on recording media by performing the steps of charging, exposure, development, transfer, fixing, cleaning and charge erasing.

In the charging step, the surface of a photoreceptor that is rotationally driven is uniformly electrified by a charging device. In the exposure step, the electrified photoreceptor surface is illuminated with a laser beam from an exposure device to form an electrostatic latent image corresponding to image data. In the developing step, the electrostatic latent image on the photoreceptor surface is developed by a developing device to form a toner image. In the transfer step, the toner image formed on the photoreceptor surface is transferred to a recording medium by a transfer device. In the fixing step, the transferred toner image is heated and pressed by a fusing device so as to be fixed to the recording medium.

In the cleaning step, the residual toner remaining on the photoreceptor surface after toner transfer is removed by a cleaning device so that the photoreceptor surface is cleaned. The toner removed at this time is collected into a predetermined collecting portion. In the charge erasing step, the photoreceptor surface after cleaning is cleared of residual charge by a charge erasing device to prepare for a next image forming operation.

In the thus constructed image forming apparatus, a mono-component developer consisting of a toner only or a dual-component developer consisting of a toner and a carrier is used as the developer to develop the electrostatic latent image.

Since the mono-component developer does not need to have an agitating mechanism for mixing toner and carrier to be uniform, use of the mono-component developer is advantageous in making the configuration of the developing device simple and compact, though there is a drawback that the static charge on the toner is unlikely to be stabilized.

On the other hand, since the dual-component developer needs to have an agitating mechanism for mixing the toner and carrier to be uniform, there is a drawback that the developing device becomes complicated and enlarged. However, since the dual-component developer has the advantage that it presents stable charge performance and suitability to high-speed machines, it is often used for high-speed image forming apparatuses and color image forming apparatuses.

Recently, in order to meet the demands of the users for energy saving and high-quality image printout, micro toners having a low softening temperature and a volume mean diameter as low as 5 μm to 9 μm have become often used. Though the micro-sized toner of this kind is designed to be fixable at a low temperature and is effective in enhancing resolution and reducing granulation to achieve improved image quality.

The toner in the dual-component developer is consumed every time development is performed, so that a toner supply device for supplying toner into the developing device in accordance with the amount of toner consumption is provided inside the developing device. As the toner supply device for this purpose, there has been a known toner supply device which, for example, includes a screw auger as a toner discharging member that is rotated to convey the toner to a toner discharge port and supply it to the developing device (patent document 1: Japanese Patent Application Laid-open 2001-83802).

However, in the aforementioned toner supply device using the toner discharging member formed of a screw auger, there would occur the phenomenon that lumps of toner residing in the gap of the screw auger suddenly flow out from the toner supply device to the developing device due to vibration etc. of the image forming apparatus even when no toner supply is performed or when the developer is sufficiently high in toner concentration. Accordingly, there has been the problem that the amount of toner supply from the toner supply device to the developing device cannot be controlled exactly.

SUMMARY OF THE INVENTION

The present invention has been devised in view of the above conventional problems, it is therefore an object of the present invention to provide a developing device which has a simple configuration and still can achieve exact control of the amount of toner supply to the developing device as well as providing an image forming apparatus and toner supply control method using the device.

In order to achieve the above object, the developing device of the present invention, image forming apparatus and toner supply control method using the device are configured as follows:—

The developing device according to the first aspect of the present invention includes: a developer conveying passage through which a developer containing a toner and a magnetic carrier is conveyed; a developer conveying member disposed in the developer conveying passage to agitate and convey the developer in a predetermined direction; and a toner supply passage for leading supplementary toner into the developer conveying passage, and is characterized in that an electromagnet(s) for forming a magnetic field inside the toner supply passage is provided along the outer periphery of the toner supply passage.

That is, the first aspect of the present invention resides in that a magnetic field is generated inside the toner supply passage by the electromagnet(s) arranged along the outside periphery of the toner supply passage, for example so as to have the developer attracted to the magnetic field generated by the electromagnet(s) to thereby temporarily close the toner supply passage.

The developing device according to the second aspect of the present invention is constructed such that a plurality of electromagnets are disposed apart across the toner supply passage so that the plural electromagnets form a magnetic field in which magnetic field lines are directed in the same direction inside the toner supply passage.

The developing device according to the third aspect of the present invention is constructed such that the magnetic field formed by the electromagnet(s) is specified so that the magnetic flux density inside the toner supply passage falls within the range from 500 mT to 2,000 mT.

The developing device according to the fourth aspect of the present invention is constructed such that the electromagnet(s) is arranged at a position 5 to 30 mm away from the surface of the developer in the developer conveying passage below the toner supply passage.

The developing device according to the fifth aspect of the present invention is constructed such that the distance between the electromagnets arranged opposing each other across the toner supply passage is specified to be 5 to 25 mm.

Further, according to the sixth aspect of the present invention, the image forming apparatus for forming images based on electrophotography, including: a developing device for forming a toner image by supplying toner to an electrostatic latent image formed on the photoreceptor drum surface; and a toner supply device for supplying the toner to the developing device is characterized in that the developing device employs the developing device specified in any one of the above first to fifth aspects.

The seventh aspect of the present invention resides in a toner supplying method for supplying toner from a toner supply device to a developing device which includes: a developer conveying passage through which a developer containing a toner and a magnetic carrier is conveyed; and a toner supply passage for leading supplementary toner into the developer conveying passage, by way of the toner supply passage, comprising the steps of: generating a magnetic field inside the toner supply passage when toner supply from the toner supply device to the developing device is not performed; and generating no magnetic field inside the toner supply passage when toner supply from the toner supply device to the developing device is performed.

That is, the seventh aspect of the present invention includes: a step of closing the toner supply passage by the developer that is attracted to the magnetic field by energizing the electromagnet(s) provided along the outside periphery of the toner supply passage so as to generate the magnetic field, when, for example toner supply from the toner supply device to the developing device is not performed; and a step of opening the toner supply passage by deactivating the electromagnet(s) to cancel the magnetic field when toner supply from the toner supply device to the developing device is performed.

According to the developing device of the first aspect of the present invention, the developer can be attracted to the magnetic field generated by the electromagnet(s) so as to temporarily close the toner supply passage. Accordingly, it is possible to prevent toner from accidentally falling and being supplied from the toner supply device into the developer, by closing the toner supply pipe at the time other than when toner is tone supplied. As a result, it is possible to suppress toner scattering and image fogging, which would occur due to excessive increase in toner concentration.

According to the developing device of the second aspect of the present invention, since a dense magnetic brush shutter can be formed so that it is possible to totally trap the toner that accidentally drops from the toner supply device.

According to the developing device of the third aspect of the present invention, it is possible to create a magnetic brush shutter without lowering the fluidity of the developer inside the developer conveying passage when the developing device is in operation.

According to the developing device of the fourth aspect of the present invention, it is possible to create a reliable magnetic brush shutter.

According to the developing device of the fifth aspect of the present invention, it is possible to create a reliable magnetic brush shutter.

According to the image forming apparatus of the sixth aspect of the present invention, it is possible to produce images free from toner soil and image fogging due to toner scattering.

According to the toner supply control method of the seventh aspect of the present invention, it is possible to close the toner supply passage by the developer attracted to the magnetic field and open the toner supply passage by cancellation of the magnetic field. As a result, there is no risk of toner being supplied when no toner supply is needed, hence it is possible to stably control toner concentration.

DESCRIPTION OF THE PREFERRED EMBODIMENTS

The best mode for carrying out the present invention will hereinafter be described with reference to the accompanying drawings.

Figure 1:
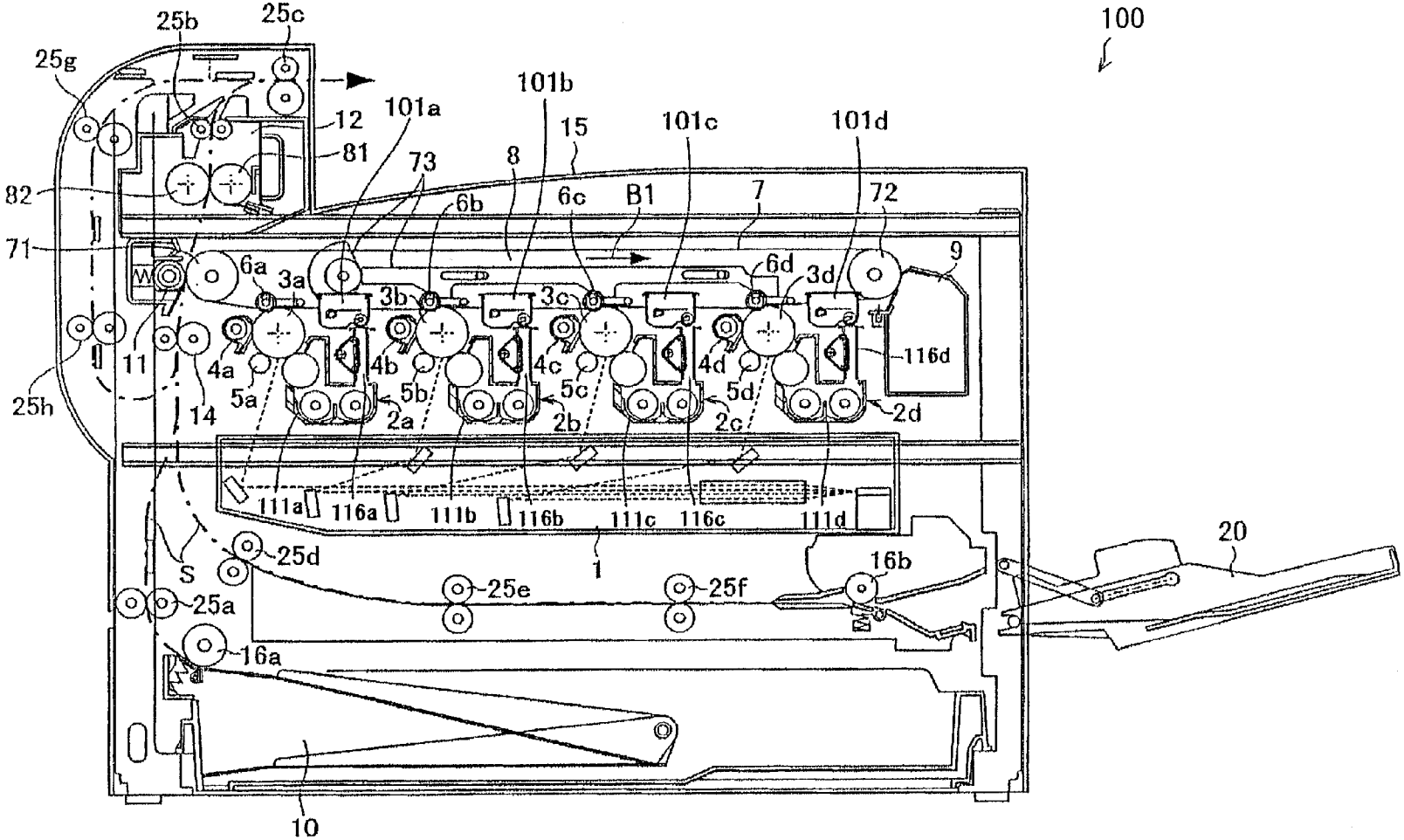
FIG. 1 is an illustrative view showing the overall configuration of an image forming apparatus to which a developing device according to the embodiment of the present invention is applied.

FIG. 1 shows one exemplary embodiment mode of the invention and is an illustrative view showing the overall configuration of an image forming apparatus to which a developing device according to the embodiment of the present invention is applied.

An image forming apparatus 100 of the present embodiment forms an image with toners based on electrophotography, including: as shown in FIG. 1, photoreceptor drums 3 (3*a*, 3*b*, 3*c* and 3*d*) for forming electrostatic latent images on the surface thereof; chargers (charging devices) 5 (5*a*, 5*b*, 5*c* and 5*d*) for charging the surfaces of photoreceptor drums 3; an exposure unit (exposure device) 1 for forming electrostatic latent images on the photoreceptor drum 3 surfaces; developing devices 2 (2*a*, 2*b*, 2*c* and 2*d*) for supplying toners to the electrostatic latent images on the photoreceptor drum 3 surfaces to form toner images; toner supply devices (toner supplying devices) 101 (101*a*, 101*b*, 101*c* and 101*d*) for supplying toners to developing devices 2; an intermediate transfer belt unit (transfer device) 8 for transferring the toner images from the photoreceptor drum 3 surfaces to a sheet (recording paper, recording medium); and a fusing unit (fusing device) 12 for fixing the toner image to the sheet.

Here, the symbols a to d are used so that 'a' represents the components for forming black images, 'b' the components for forming cyan images, 'c' the components for forming magenta images and 'd' the components for forming yellow images. This notation will be used in the same manner hereinbelow.

This image forming apparatus 100 forms a multi-color or monochrome image on a predetermined sheet in accordance with image data transmitted from the outside. Here, image forming apparatus 100 may also include a scanner or the like on the top thereof.

To being with, the overall configuration of image forming apparatus 100 will be described.

As shown in FIG. 1, image forming apparatus 100 handles image data of separate color components, i.e., black (K), cyan (C), magenta (M) and yellow (Y), and forms black, cyan, magenta and yellow images to form a full-color image from the images of different color components, by superposing one over another.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four charging devices 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4, are provided.

Further, image forming apparatus 100 includes exposure unit 1, fusing unit 12, a sheet conveyor system S and a paper feed tray 10 and a paper output tray 15.

Charger 5 uniformly charges the photoreceptor drum 3 surface at a predetermined potential.

As charger 5, other than the contact roller-type charger shown in FIG. 1, a contact brush-type charger, a non-contact type discharging type charger or the like may be also used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may also be used as exposure unit 1. Exposure unit 1 illuminates the photoreceptor drums 3 that have been electrified, in accordance with input image data to thereby form electrostatic latent images corresponding to the image data on the surfaces of photoreceptor drums 3.

Developing device 2 visualizes (develops) the electrostatic latent image formed on photoreceptor drum 3 with toner of K, C, M or Y. Developing device 2 (2*a*, 2*b*, 2*c* or 2*d*) includes a toner supply device 101 (101*a*, 101*b*, 101*c* or 101*d*), a toner supply pipe 116 (116*a*, 116*b*, 116*c* or 116*d*), a developing vessel (developer receptacle) 111 (111*a*, 111*b*, 111*c* or 111*d*).

Toner supply device 101 is arranged on the upper side of developing vessel 111 with respect to the vertical direction and stores unused toner (power toner) Toner is supplied from toner supply device 101 to developing vessel 111 through toner supply pipe 116.

Cleaner unit 4 removes and collects the toner remaining on the photoreceptor drum 3 surface after development and image transfer.

Arranged over photoreceptor drums 3 are an intermediate transfer belt unit 8.

Intermediate transfer belt unit 8 includes intermediate transfer rollers 6 (6*a*, 6*b*, 6*c* and 6*d*), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B1 in FIG. 1.

Intermediate transfer rollers 6 are rotatably supported at respective intermediate transfer roller fitting portions in intermediate transfer belt tensioning mechanism 73 of intermediate transfer belt unit 8. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multi-color toner image). This intermediate transfer belt 7 is formed of an endless film of about 100 μm to 150 μm thick, for instance.

Transfer of the toner image from photoreceptor drum 3 to intermediate transfer belt 7 is effected by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.,) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image formed on each of photoreceptor drums 3 is developed with the toner associated with its color component into a visual toner image. These toner images are laminated on intermediate transfer belt 7, one image over another. The thus formed lamination of toner images is moved by rotation of intermediate transfer belt 7 to the contact position (transfer position) between the conveyed sheet and intermediate transfer belt 7, and is transferred to the sheet by a transfer roller 11 arranged at that position. In this case, intermediate transfer belt 7 and transfer roller 11 are pressed against each other forming a predetermined nip while a voltage for transferring the toner image to the sheet is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Since the toner adhering to intermediate transfer belt 7 as the belt comes in contact with photoreceptor drums 3, or the toner which has not been transferred from intermediate transfer belt 7 to the sheet during transfer of the toner image and remains on intermediate transfer belt 7, would cause contamination of color toners at the next operation, it is removed and collected by an intermediate transfer belt cleaning unit 9.

Intermediate transfer belt cleaning unit 9 includes a cleaning blade (cleaning member) that comes into contact with intermediate transfer belt 7. Intermediate transfer belt 7 is supported from its interior side by intermediate transfer belt driven roller 72, at the portion where this cleaning blade comes into contact with intermediate transfer belt 7.

Paper feed tray 10 is to stack sheets to be used for image forming and is disposed under image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fusing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion (transfer roller 11), fusing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the side of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 is a roller that temporarily suspends the sheet being conveyed on sheet conveyor system S and delivers it to the transfer portion at such timing that the front end of the sheet meets the front end of the toner image data area on intermediate transfer belt 7.

Fusing unit 12 includes a heat roller 81, a pressing roller 82 and the like. These heat roller 81 and pressing roller 82 rotate while nipping the sheet. Heat roller 81 is controlled by a controller (not shown) so as to keep a predetermined fusing temperature. This controller controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. Then, the sheet with a multi-color toner image (a single color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out, as described above. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the toner image data area containing a lamination of toner images on intermediate transfer belt 7. At the transfer portion, the toner image is transferred onto the sheet. Then, this toner image is fixed onto the sheet by fusing unit 12. Thereafter, the sheet passes through feed roller 25*b* to be discharged by paper output roller 25*c* to paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fusing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, developing device 2 will be described with reference to the drawings.

Figure 2:
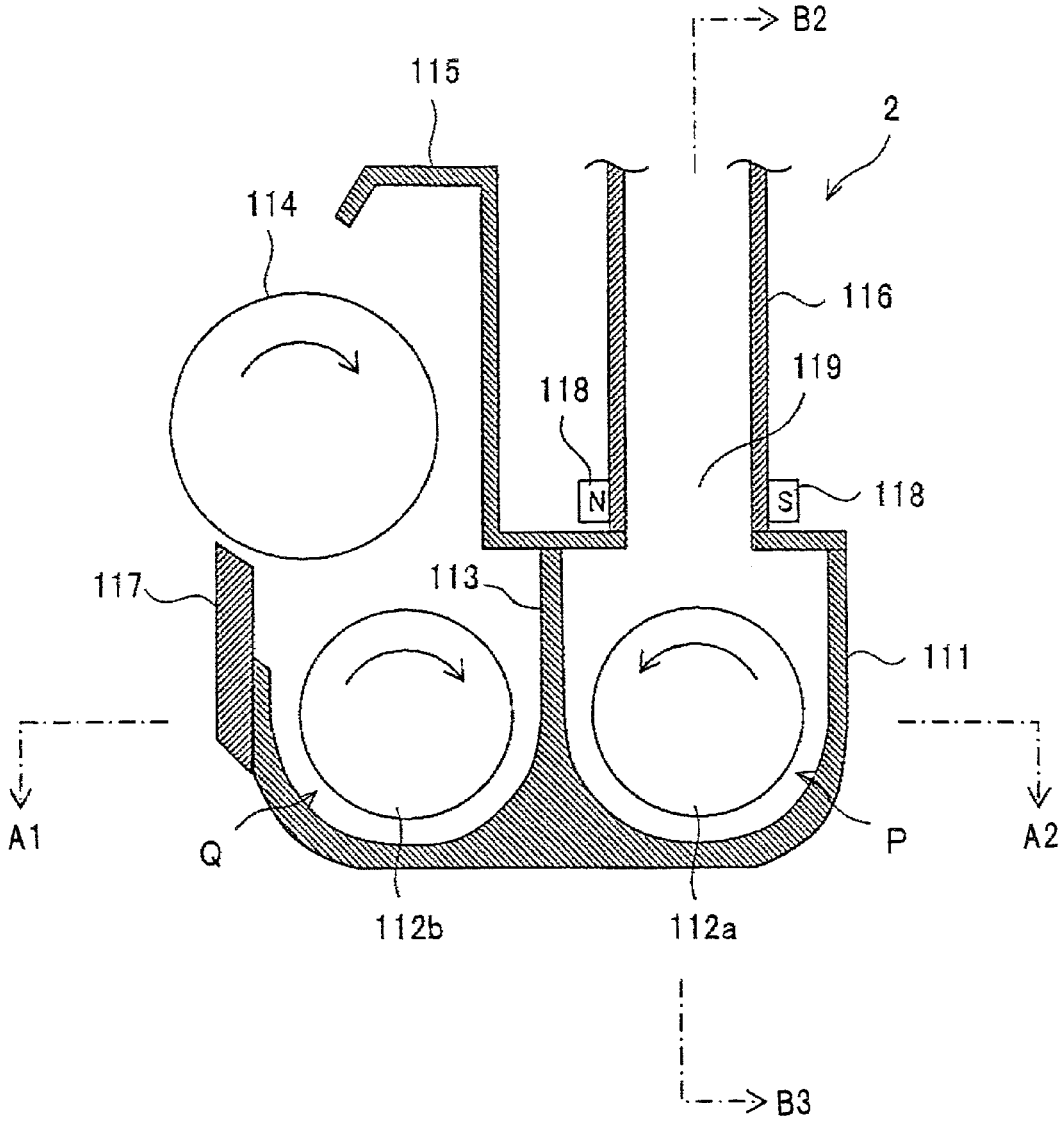
FIG. 2 is a sectional view showing a configuration of a developing device that constitutes the above image forming apparatus.
Figure 3:
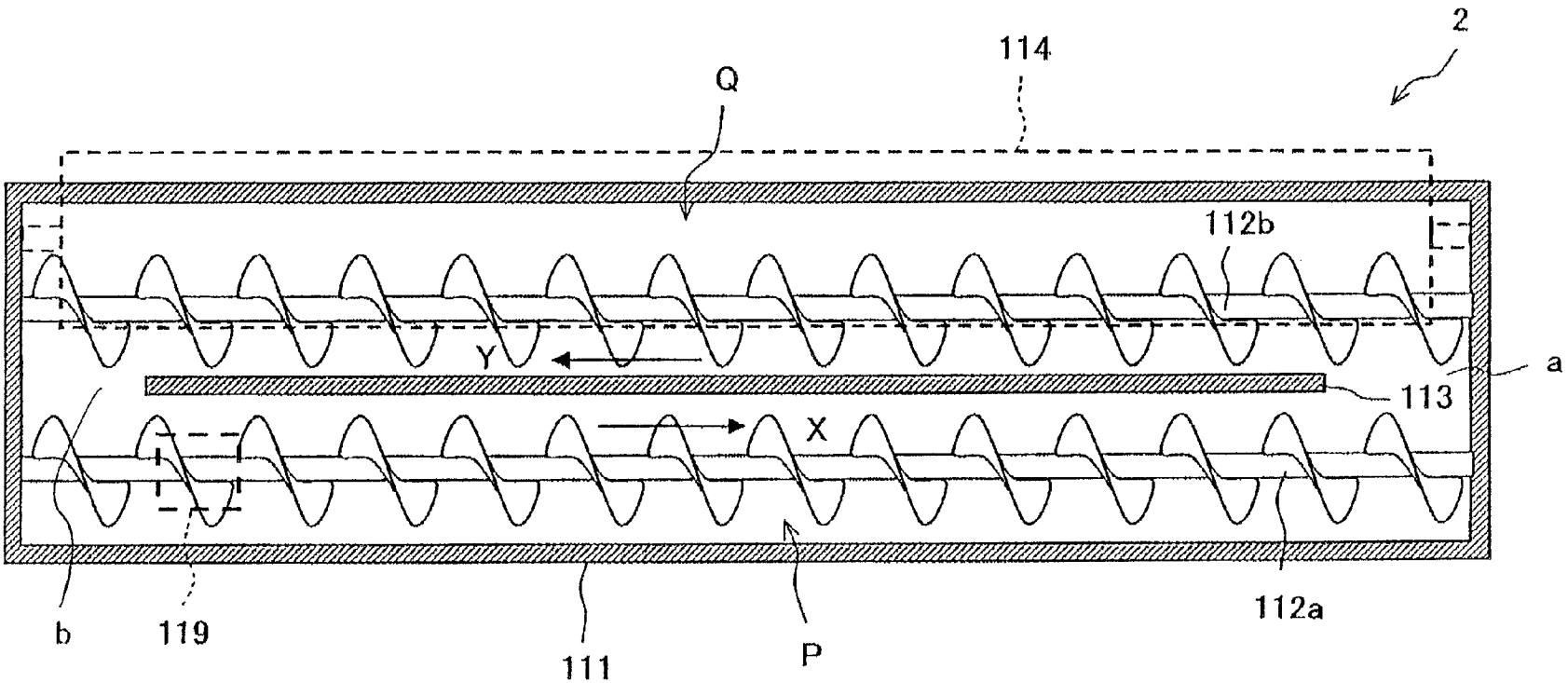
FIG. 3 is a sectional view, cut along plane A1-A2.
Figure 4:
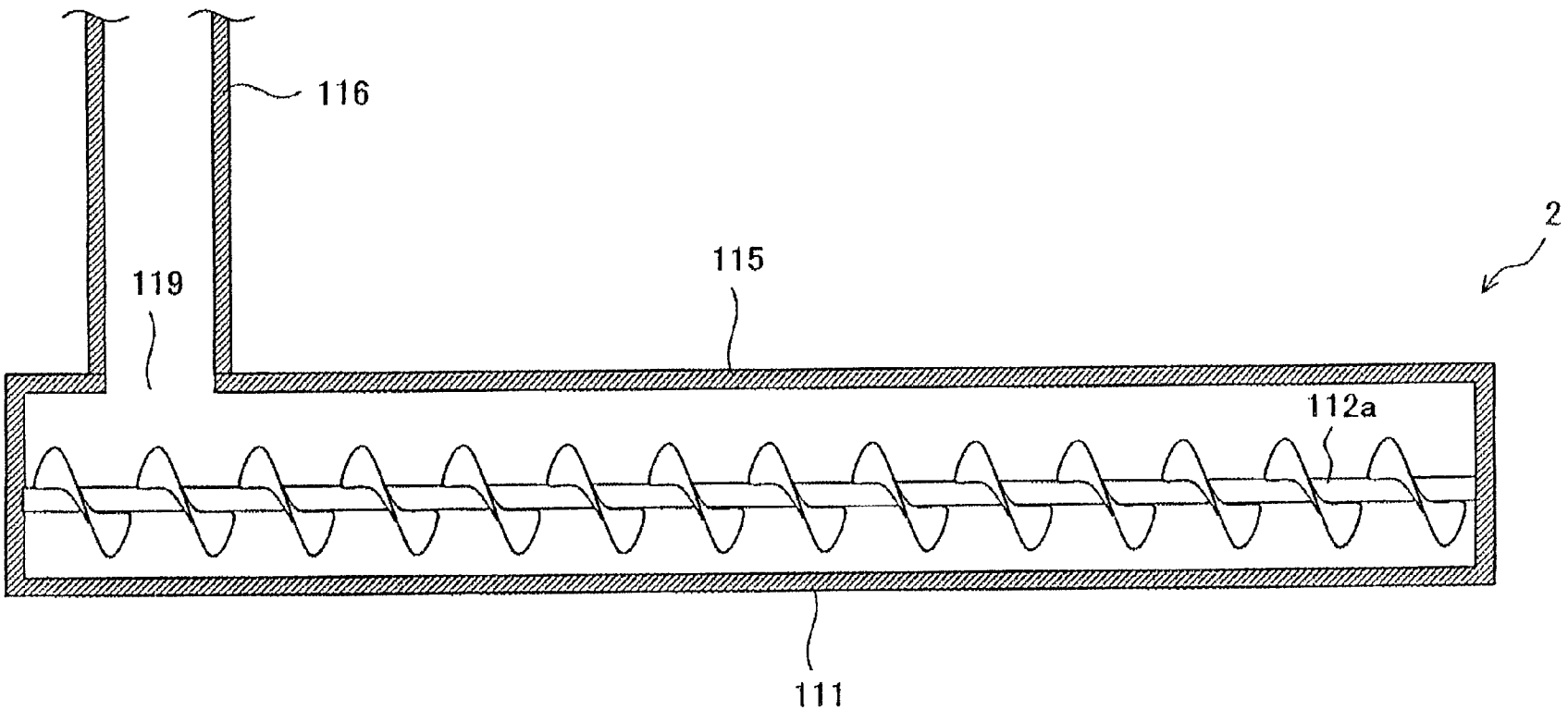
FIG. 4 is a sectional view, cut along plane B2-B3.

FIG. 2 is a sectional view showing the configuration of the developing device constituting the image forming apparatus of the present embodiment; FIG. 3 is a sectional view cut along a plane A1-A2 in FIG. 2; and FIG. 4 is a sectional view cut along a plane B2-B3 in FIG. 2.

As shown in FIG. 2, developing device 2 has a developing roller (developer supporting member) 114 arranged in developing vessel 111 so as to oppose photoreceptor drum 3 (FIG. 2), and supplies toner from developing roller 114 to the photoreceptor drum 3 surface to visualize (develop) the electrostatic latent image formed on the surface of photoreceptor drum 3.

Developing device 2 includes, other than developing roller 114, developing vessel 111, a developing vessel cover 115, a toner supply port 119, a doctor blade 117, a first conveying member 112*a*, a second conveying member 112*b*, a partitioning plate (partitioning wall) 113, toner supply pipe 116 and an electromagnet 118.

Developing vessel 111 holds a dual-component developer (which will be referred to hereinbelow as merely "developer" containing a toner and a carrier. Developing vessel 111 includes developing roller 114, first conveying member 112*a*, second conveying member 112*b* and the like. Here, the carrier of the present embodiment is a magnetic carrier presenting magnetism.

Developing roller 114 is a rotating magnet roller which draws up the developer in developing vessel 111 and supports the developer on the surface thereof and supplies toner from the developer supported on the surface thereof to photoreceptor drum 3. Doctor blade (layer thickness regulating blade) 117 is disposed at a position close to the developing roller 114 surface.

Arranged on the top of developing vessel 111 is removable developing vessel cover 115, as shown in FIGS. 2 and 4. Further, developing vessel cover 115 is formed with toner supply port 119 forming a square passage hole for supplying unused toner to developing vessel 111, as shown in FIGS. 3 and 4, which is coupled with quadrangular prism-shaped toner supply pipe 116 with a toner passage hole having a square cross-section.

The toner passage hole of toner supply pipe 116 is arranged in the vertical direction between toner supply device 101 and developing vessel 111. However, the arrangement of the toner passage hole should not be limited to the vertical direction, but it can be oriented in any other direction as long as toner can fall from toner supply device 101 into developing vessel 111.

In this arrangement, the toner stored in toner supply device 101 is transferred to developing vessel 111 by way of toner supply pipe 116 and toner supply port 119 as shown in FIG. 1, whereby toner is supplied to developing vessel 111.

A pair of electromagnets 118 (FIG. 2) are arranged in the vicinity of toner supply port 119 opposing each other across toner supply pipe 116. Electromagnets 118 and 118 are arranged so that the two faces opposing each other across toner supply pipe 116 have opposite polarities, N pole and S pole, respectively.

The magnetic flux density of the magnetic field formed by electromagnets 118 in toner supply pipe 116 is preferably specified to fall within the range from 500 mT to 2,000 mT. That is, when the magnetic flux density is less than 500 mT, it is difficult to form a sufficient enough magnetic brush shutter J (FIG. 5), which will be described later. On the other hand, when the magnetic flux density exceeds 2,000 mT, a large amount of developer is attracted to the magnetic field of electromagnets 118, so that magnetic brush shutter J is formed with the excessive amount of developer. As a result, the amount of developer to be conveyed by first conveying member 112*a* lowers and the fluidity of the developer conveyed by second conveying member 112*b* also lowers, degrading performance of developer conveyance to developing roller 114.

Each electromagnet 118 is preferably positioned at a height 5 mm to 30 mm away and above the developer surface in first conveying member 112*a*. That is, when the distance of electromagnet 118 from the developer surface in first conveying member 112*a* is less than 5 mm, an excessive amount developer is attracted to the magnetic field of electromagnets 118, and magnetic brush shutter J is formed inside toner supply pipe 116 by that excessive amount of developer. As a result, the amount of developer to be conveyed by first conveying member 112*a* lowers and the fluidity of the developer conveyed by second conveying member 112*b* also lowers, degrading performance of developer conveyance to developing roller 114. On the other hand, if the distance of each electromagnet 118 from the developer surface inside first conveying member 112*a* exceeds 30 mm, the magnetic field of electromagnets 118 fails to exert an influence on the developer inside first conveying member 112*a*, hence it is difficult to form a sufficient enough magnetic brush shutter J inside toner supply pipe 116.

It should be noted that the number of electromagnets 118 for forming magnetic brush shutter J is not particularly limited.

Further, specifying the distance between two electromagnets 118 and 118 arranged opposing each other across toner supply pipe 116 to be 5 to 25 mm, makes it possible to reliably form magnetic brush shutter J.

Toner supply to developing vessel 111 is performed as shown in FIG. 1, so that the toner stored in toner supply device 101 is transferred from toner supply port 119 to developing vessel 111 through toner supply pipe 116.

Further, as shown in FIG. 3, first conveying member 112*a* and second conveying member 112*b* are formed of screw augers of a helical conveyor blade for agitating and conveying the developer in developing vessel 111 so as to agitate and convey the developer as their shafts are rotationally driven by a drive means (not shown) such as a motor etc.

An unillustrated toner concentration detecting sensor is provided at the bottom surface of developing vessel 111 vertically below second conveying member 112*b* so that its sensor face is exposed to the interior of developing vessel 111. The toner concentration detecting sensor is electrically connected to an unillustrated controller. When this controller determines that the detection result from the toner detecting sensor is lower than a set toner concentration value, it sends out a control signal for activating the toner supply function to toner supply device so as to start toner supply.

First conveying member 112*a* and second conveying member 112*b* are arranged so that their peripheral sides oppose each other with a partitioning plate 113 put therebetween and their shafts are positioned parallel to each other. These conveying members rotate in opposite directions. As shown in FIG. 3, first conveying member 112*a* conveys the developer in the direction of arrow X while second conveying member 112*b* conveys the developer in the direction of an arrow Y that is the opposite direction of arrow X.

Developing vessel 111 includes partitioning plate 113 between first conveying member 112*a* and second conveying member 112*b*. This partitioning plate 113 is arranged extending parallel to the direction of the shafts (the direction of rotational axes) of first and second conveying members 112*a* and 112*b*. The interior of developing vessel 111 is divided by partitioning plate 113 into two sections, namely, a first conveying passage P with first conveying member 112*a* and a second conveying passage Q with second conveying member 112*b*.

Partitioning plate 113 is arranged so that its ends, with respect to the axial direction of first and second conveying members 112*a* and 112*b*, are spaced from respective interior wall surfaces of developing vessel 111. Hereby, developing vessel 111 has communicating paths that communicate between first conveying passage P and second conveying passage Q at around both axial ends of first and second conveying members 112*a* and 112*b*. In the following description, the communicating path formed on the side to which arrow X is directed is named first communicating path a and the communicating path formed on the side to which arrow Y is directed is named second communicating path b.

In the present embodiment, toner supply port 119 is formed in the region inside first conveying passage P and on the downstream side of second communicating path b with respect to the direction of arrow X. In one word, toner is supplied into first conveying passage P at a position on the downstream side of second communicating path b.

In developing vessel 111, first conveying member 112*a* and second conveying member 112*b* are rotationally driven by a drive means (not shown) such as a motor etc., to convey the developer.

More specifically, in first conveying passage P, the developer is agitated and conveyed in the direction of arrow X by first conveying member 112*a* to reach first communicating path a. The developer reaching first communicating path a is conveyed therethrough to second conveying passage Q.

On the other hand, in second conveying passage Q, the developer is agitated and conveyed in the direction of arrow Y by second conveying member 112*b* to reach second communicating path b. Then, the developer reaching second communicating path b is conveyed therethrough to first conveying passage P.

That is, first conveying member 112*a* and second conveying member 112*b* agitate the developer while conveying the developer in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as moving toward photoreceptor drum 3.

In order to compensate for this consumption of toner, unused toner is supplied from toner supply port 119 into first conveying passage P. The supplied toner is agitated and mixed with the previously existing developer in the first conveying passage P.

Now, the characteristic operation of electromagnets 118 in toner supply pipe 116 of developing device 2 will be described with reference to the drawings.

Figure 5:
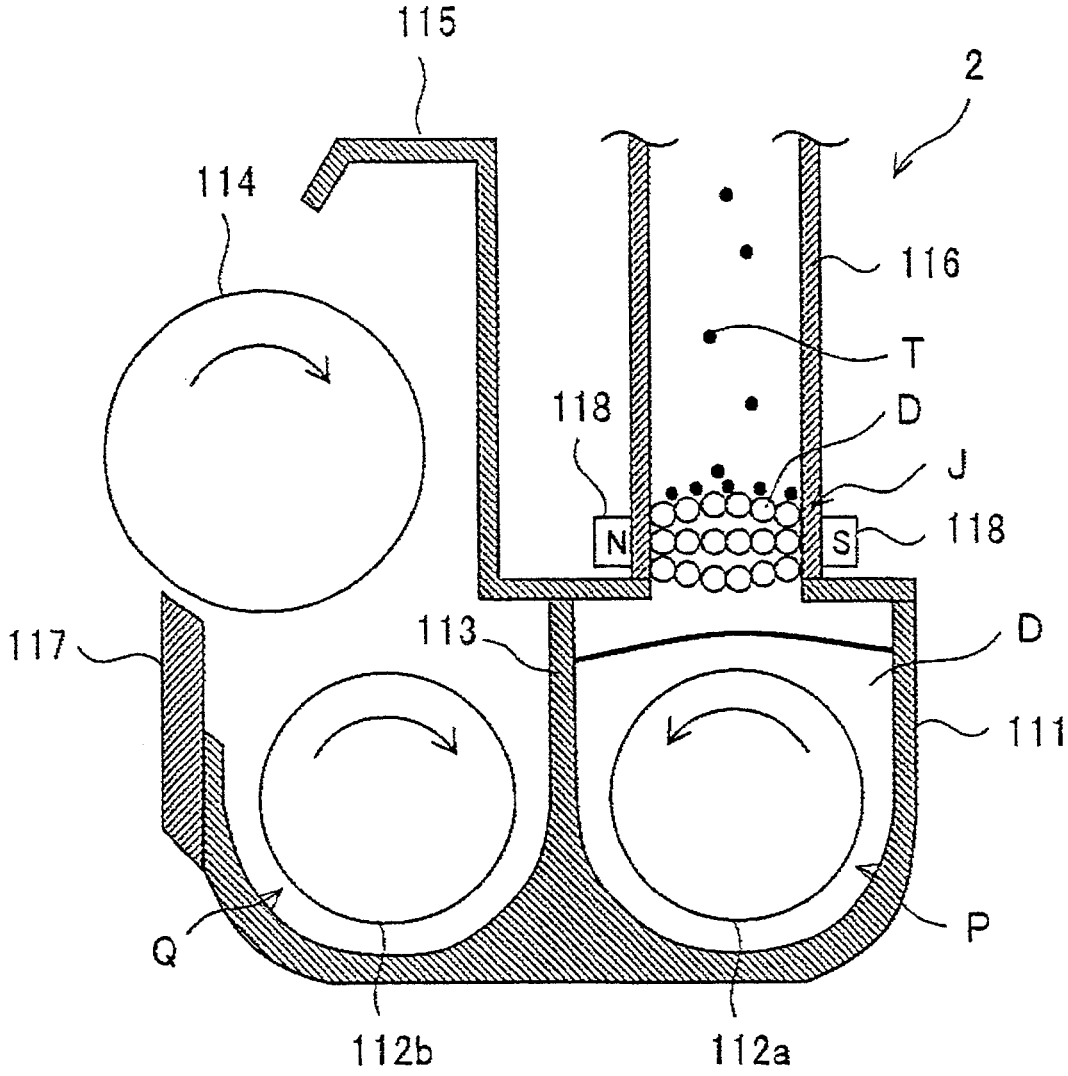
FIG. 5 is an illustrative view showing the developing device where a magnetic brush shutter is being formed by the developer inside a toner supply pipe when electromagnets are energized; and, FIG. 6 is an illustrative view showing the developing device where the magnetic brush shutter has vanished inside the toner supply pipe when the electromagnets is deactivated.
Figure 6:
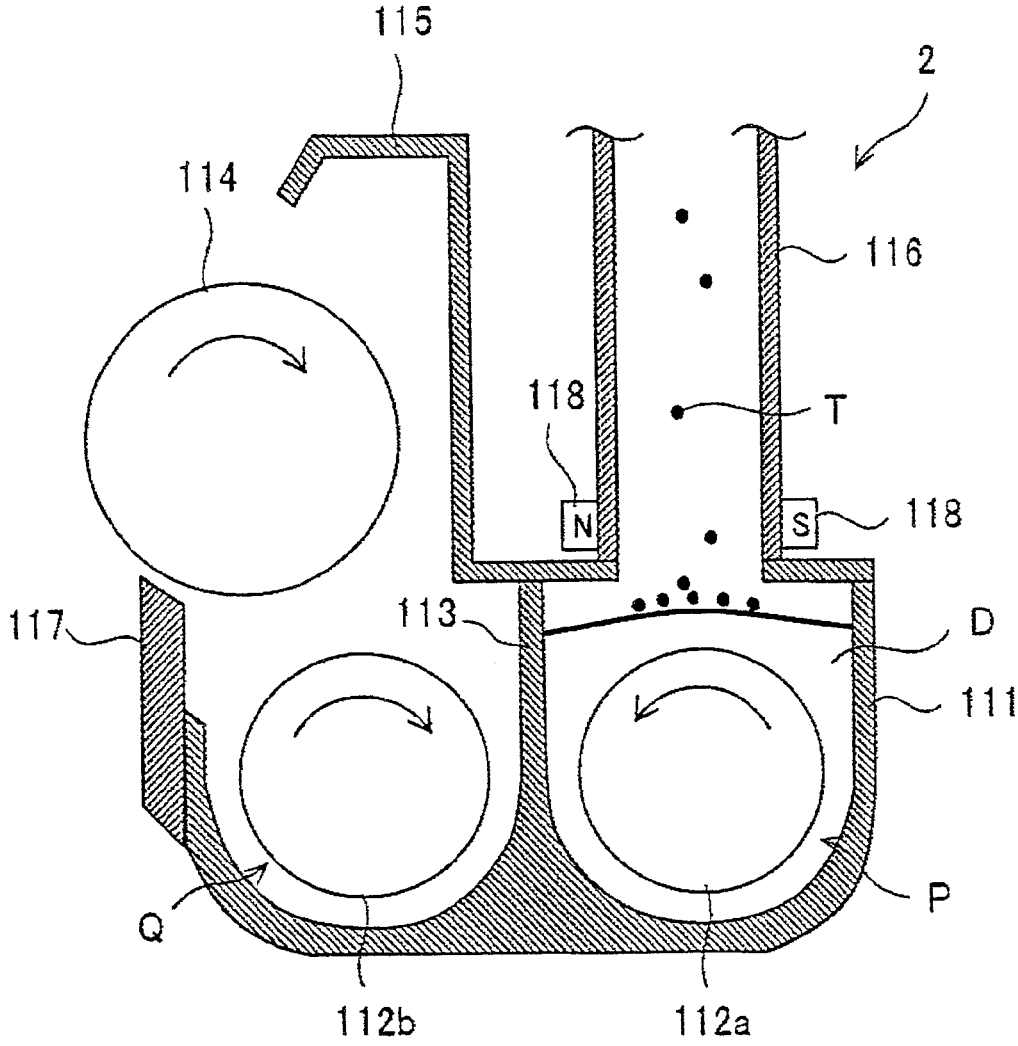

FIG. 5 is an illustrative view showing the developing device of the image forming apparatus according to the present embodiment where a magnetic brush shutter J is being formed by the developer inside the toner supply pipe when the electromagnets are energized. FIG. 6 is an illustrative view showing the same developing device where the magnetic brush shutter has vanished inside the toner supply pipe when the current through the electromagnets is stopped.

In developing device 2, when electromagnets 118 arranged at the outer periphery of toner supply pipe 116 is being energized, developer D inside first conveying member 112*a* is attracted to the magnetic field generated by electromagnets 118 so that magnetic brush shutter J is created by developer D inside toner supply pipe 116 as shown in FIG. 5. Under this condition, if toner T accidentally falls from toner supply device 101 due to vibration etc., the toner is trapped by magnetic brush shutter J. Accordingly, it is possible to prevent toner T from being supplied into developing vessel 111.

As a result, when toner supply from toner supply device 101 to developing device 2 is not performed, it is possible to prevent unnecessary toner T from being supplied into developing vessel 111, by energizing electromagnets 118 so as to generate a magnetic field inside toner supply pipe 116, thereby create magnetic brush shutter J of developer D.

On the other hand, when electromagnets 118 are deactivated, no magnetic field is formed inside toner supply pipe 116, hence developer D which was attracted by the magnetic field drops into developing vessel 111, hence will not create magnetic brush shutter J any longer, as shown in FIG. 6. Accordingly, in this state, there exists no obstruction against toner supply to toner supply pipe 116 when toner T supplied from toner supply device 101 to developing vessel 111 is performed.

As a result, when toner supply from toner supply device 101 to developing vessel 111 is performed, toner T supplied from toner supply device 101 is smoothly delivered into developer vessel 111.

According to the present embodiment having the configuration as above, in developing device 2, electromagnets 118 for forming a magnetic field inside toner supply pipe 116 are provided along the outer periphery of toner supply pipe 116 for supplying toner into developing vessel 111. Accordingly, it is possible to prevent unnecessary toner from being supplied into developing vessel 111 by temporarily forming magnetic brush shutter J of developer D inside toner supply pipe 116 only when electromagnets 118 are energized. As a result, it is possible to perform exact control of the amount of toner supplied into developing vessel 111.

That is, according to the present embodiment, it is possible to control whether toner is allowed or disallowed to fall through toner supply pipe 116 with a simple configuration without providing any complicated constituents such as a mechanical shutter etc. inside toner supply pipe 116.

Though the above embodiment was described taking an example in which developing device 2 is applied to image forming apparatus 100 shown in FIG. 1, as long as it is an image forming apparatus which uses developing device 2 for supplying toner to developing vessel 111 using toner supply device 101, the invention can be developed to any other image forming apparatus and the like, not limited to the image forming apparatus and copier described above.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. A developing device comprising:

a developer conveying passage through which a developer containing a toner and a magnetic carrier is conveyed;

a developer conveying member disposed in the developer conveying passage to agitate and convey the developer in a predetermined direction; and, a toner supply passage for leading supplementary toner into the developer conveying passage, wherein one or more electromagnets for forming a magnetic field inside the toner supply passage are provided along the outer periphery of the toner supply passage;

wherein a plurality of electromagnets are disposed apart across the toner supply passage so that the plurality of electromagnets form a magnetic field in which magnetic field lines are directed in the same direction as each other inside the toner supply passage;

wherein the magnetic field formed by the one or more electromagnets is specified so that the magnetic flux density inside the toner supply passage falls within the range from 500 mT to 2,000 mT;

wherein the one or more electromagnets are arranged at a position 5 to 30 mm away from the surface of the developer in the developer conveying passage below the toner supply passage; and wherein the distance between the one or more electromagnets arranged opposing each other across the toner supply passage is specified to be 5 to 25 mm.

2. An image forming apparatus for forming images based on electrophotography, comprising:

a developing device for forming a toner image by supplying toner to an electrostatic latent image formed on a photoreceptor drum surface; and, a toner supply device for supplying the toner to the developing device, characterized in that the developing device is the developing device defined in claim 1.

3. A toner supplying method for supplying toner from a toner supply device to a developing device which includes: a developer conveying passage through which a developer containing a toner and a magnetic carrier is conveyed; and a toner supply passage for leading supplementary toner into the developer conveying passage, by way of the toner supply passage, comprising the steps of:

generating a magnetic field inside the toner supply passage when toner supply from the toner supply device to the developing device is not performed, the magnetic field being generated by a plurality of electromagnets disposed apart across the toner supply passage so that the plurality of electromagnets form a magnetic field in which magnetic field lines are directed in the same direction as each other inside the toner supply passage; and generating no magnetic field inside the toner supply passage when toner supply from the toner supply device to the developing device is performed, wherein the magnetic field formed by the plurality of electromagnets is specified so that the magnetic flux density inside the toner supply passage falls within the range from 500 mT to 2,000 mT;

wherein the plurality of electromagnets are arranged at a position 5 to 30 mm away from the surface of the developer in the developer conveying passage below the toner supply passage; and wherein the distance between the plurality of electromagnets arranged opposing each other across the toner supply passage is specified to be 5 to 25 mm.

* * * * *